US005456382A

United States Patent [19]

Gringer

[11] Patent Number: 5,456,382

[45] Date of Patent: Oct. 10, 1995

[54] BLISTER DISPLAY PACKAGE

[75] Inventor: Donald Gringer, New York, N.Y.

[73] Assignee: Allway Tools, Inc., Bronx, N.Y.

[21] Appl. No.: 227,654

[22] Filed: Apr. 14, 1994

[51] Int. Cl.[6] ..... B65G 59/00

[52] U.S. Cl. ..... 221/252; 221/287; 206/355

[58] Field of Search ..... 221/228, 232, 221/257, 279, 287, 256; 206/208, 355

[56] References Cited

U.S. PATENT DOCUMENTS

| | | | |
|---|---|---|---|
| 1,669,421 | 5/1928 | Oberg | 206/355 |
| 4,379,514 | 4/1983 | Joffe | 221/279 |
| 5,353,956 | 10/1994 | Wilson | 221/279 |

*Primary Examiner*—Kenneth Noland
*Attorney, Agent, or Firm*—Bryan Cave; David M. Klein

[57] ABSTRACT

The present invention is an apparatus and method of manufacture for a blister-type display package which includes a vacuum-formed dispenser housing, and a vacuum-formed dispenser door mounted on the rear of the housing. The housing includes a cavity to hold the objects to be dispensed and an undercut ridge adjacent to an opening in the cavity on the rear of the housing. The dispenser door has a movable portion to cover at least a portion of the cavity opening and an undercut outer ridge which cooperates with the undercut ridge on the housing to enable the movable door to be snapped into and out of a closed position. A securing lip on the door is secured to the rear of the housing. A hinge extending between the securing lip and the movable portion, enables the door to be opened and closed. A display card is heat sealed to the rear of the housing to secure the door to the housing. The card also covers any non-covered portion of the dispenser housing opening, and includes a cutout to enable the movable portion of the door to be opened and re-closed.

6 Claims, 4 Drawing Sheets

BLISTER DISPLAY PACKAGE

BACKGROUND OF THE INVENTION

1. Field of the Invention

The present invention relates generally to display packaging, and more particularly to a blister display package which includes a cover defining a cavity for storing objects to be displayed and dispensed, and a re-closable door for enabling objects to be dispensed from the cavity.

2. Description of the Prior Art

Display packages for small items such as candy, screws, razor blades etc. are well known in the art. Typically, the item to be displayed is packaged in a transparent or translucent plastic material which is adapted to be hung onto a display rack. Various types of packaging are known, some of which may be opened and re-closed, others may not be re-closed once opened.

One of the types of display packaging which may be opened and re-closed is the so-called blister or clam-shell display package. FIG. 1 shows a prior art blister display package 2 used for storing and dispensing razor blades which are stacked therein. The package includes a cover portion 4 and a bottom portion 6 connected by means of a hinge 8. The cover 4 and the bottom 6 cooperate to provide a cavity in which the razor blades are stored. In order to allow the dispenser package to be displayed, a cutout 10 is provided in each of the top cover 4 and the bottom cover 6 for mounting the display package on a display rack. The cover 4, bottom 6 and hinge 8 are constructed from a single piece of flat plastic or other material which is vacuum formed into the desired shape. The hinge 8 may also be scored to enable the cover 4 to fold over the bottom 6. The bottom 6 includes an upwardly extending ridge 12 which cooperates with a corresponding upwardly extending ridge 14 on the cover 4. These ridges are slightly undercut so that when the cover ridge 14 is pushed down onto the bottom ridge 12 the cover will be releasably secured to the bottom 6. If desired, the hinge 8 may be located in the middle of the cover 4 rather than at the end.

These types of packages are generally sold with a paper wrapper 16 glued over a portion of the outer peripheral edge of the package to prevent the bottom and top portions from being separated, i.e. opened, until a purchaser cuts the wrapper as shown. The paper wrapper 16 generally includes graphical information on the product contained in the package. Once the package is opened the torn wrapper remains on the package, which is unsightly. Moreover, since the entire cavity of the package is opened once the cover is lifted, this type of packaging is prone to having the content of the package fall out of the package, which is very inconvenient.

Obviously, it would be advantageous to have a blister display package in which the entire cavity were not exposed when the cover were opened. This would enable the items to be dispensed to be removed in a more controlled manner reducing the tendency of items in the container to fall out.

Other types of dispensers for razor blades or the like are known. For example, commonly owned U.S. Pat. No. 5,251,783 discloses a utility blade dispenser in which the blades are loaded into a preferably transparent housing on a movable blade carrier. Blades are dispensed through a dispensing slot by means of a finger guide slot. A disposal chamber is formed in the dispenser as new blades are removed and the blade carrier is moved upward. Other dispensers of this type are shown for example in U.S. Pat. Nos. 3,650,433, 4,379,514, 4,789,080, 4,826,042 and D224,290.

These types of packages/dispensers are injection molded and are more expensive to manufacture than the clam-shell type package discussed above. Accordingly, it is an object of the present invention to provide an inexpensive alterative to the typical clam-shell display package in which only a portion of the storage cavity is exposed so that items in the package may be removed in a more controlled manner.

SUMMARY OF THE INVENTION

The present invention is a blister-type display package which includes a clam-shell type dispenser door for dispensing objects from the package. The package includes a vacuum-formed dispenser housing having a cavity sized to hold the objects to be dispensed. The cavity is open on the rear of the dispenser housing and includes an undercut ridge adjacent to the opening. A lip extends laterally from the opening along the periphery of the opening.

In order to permit items to be dispensed from the package, a vacuum-formed dispenser door is provided. The door includes a securing lip to secure the dispenser door to the dispenser housing lip. A movable door portion is sized to cover at least a portion of the cavity opening and includes an undercut ridge along an outer edge thereof. The undercut ridge on the movable portion cooperates with the undercut ridge on the housing to enable the movable door to be snapped into and out of a closed position in which the door covers at least a portion of the cavity opening. A hinge, which is integral with the securing lip and the movable portion, enables the door to be opened and closed.

To secure the dispenser door securing lip to the dispenser housing lip, a display card is attached to the rear of the housing. The card is preferably heat sealed over both lips to secure them together. The card also covers any non-covered portion of the dispenser housing opening, and includes a cutout to enable the movable portion of the door to be opened and reclosed. The card may also include a cutout for allowing the display package to be attached to a display rack.

The display housing and dispenser door are preferably transparent. If desired, the dispenser door securing lip and the dispenser housing lip may be sandwiched between two cards, one of which is mounted to the front of the housing and includes a cutout around the housing cavity, the other card being mounted to the rear of the housing and comprising a cutout to enable the movable portion of the door to be opened and re-closed. A tab on the door allows it to be easily opened and closed.

In a preferred method of manufacturing the display package, a single flat sheet of transparent material suitable for being vacuum formed is used. The sheet is vacuum formed into a sheet which includes both the dispenser housing and the dispenser door, as described above. These are then separated, and the cavity filled with the objects to be dispensed. Finally, the card is heat sealed to the rear of the housing with the card securing the dispenser door securing lip to the dispenser housing lip.

DESCRIPTION OF THE PREFERRED EMBODIMENT

As shown in FIGS. 2–6, the present invention is a blister display package 20 which includes a dispenser door 22. The display package 20 includes a cover 24 which is preferably transparent and which defines a cavity in which the items to be dispensed, preferably razor blades may be stacked. In the rear view of the present invention shown in FIG. 3, the outer edge of the cover 24 is shown generally at A, and the periphery of the cavity for holding the razor blades is shown generally at B.

Figure 6:
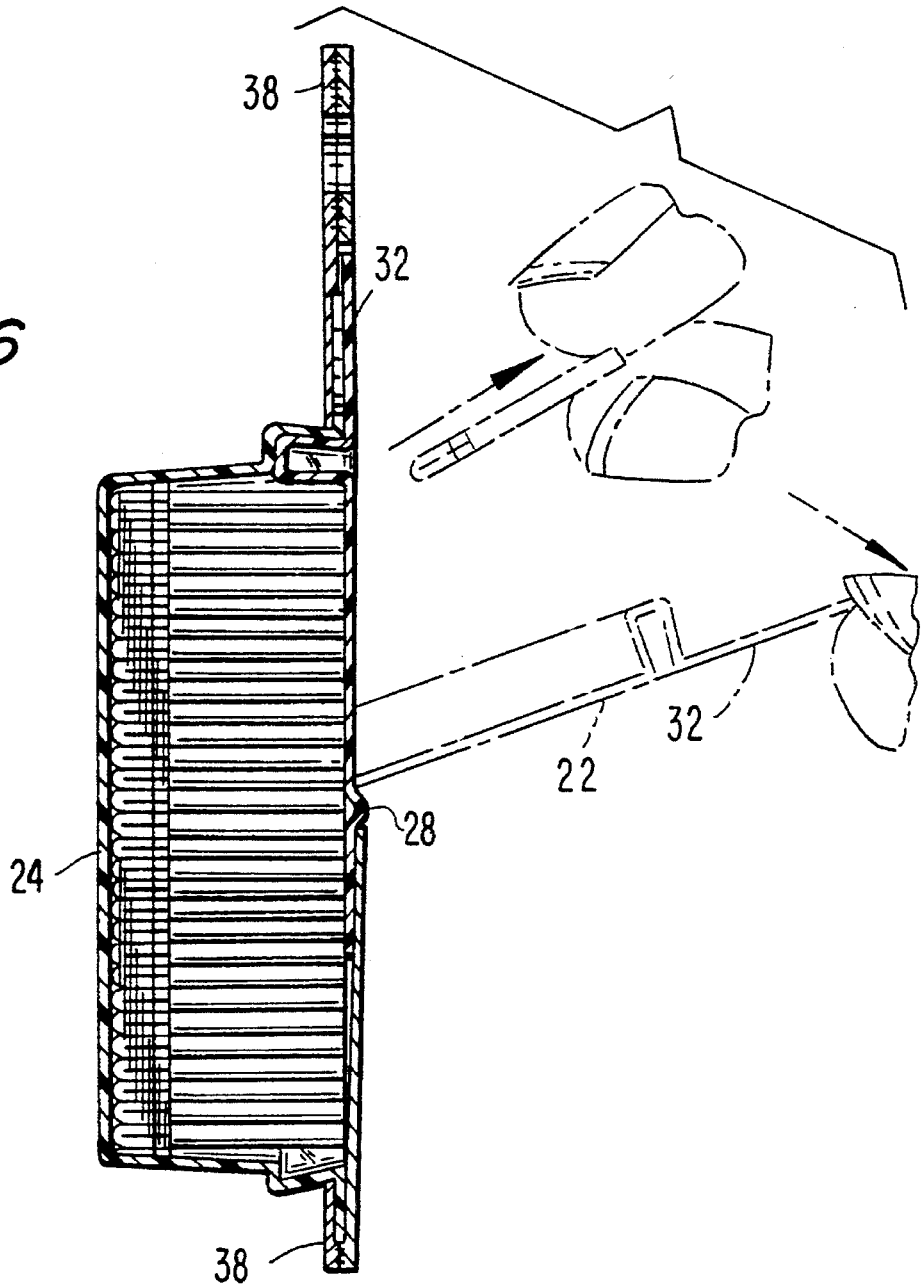
FIG. 6 is a cross-sectional side view of the blister display package of the present invention through 6—6 showing a razor blade being removed from the package.

Dispenser door 22 is preferably mounted to the rear of cover 24 covering a portion of the cavity of cover 24. Cover 22 includes a securing lip 26 which is secured to the outer peripheral portion of cover 24. Between the securing lip 26 and the door 22 a hinge 28 is provided. This enables door 22 to be opened and re-closed as shown in FIG. 6 to expose a portion of the cavity of cover 24 to enable items to be removed and/or inserted into the dispenser package. Cover 24 is provided with a cut away 30, and door 22 is provided with a corresponding tab 32. This simplifies opening and re-closing of the door 22 which is accomplished simply applying outward or inward pressure to tab 32.

Each of the cover 24 and the door 22 are made from a flat sheet of vinyl, polypropanate or other clear thermoplastic which is heated and vacuum formed into a mold while hot. If desired, a plug may be inserted into the mold during the vacuum forming process to improve the integrity of the finished display package. Once the cover 24 and/or door 22 are vacuum formed, they may be scored or perforated as desired to form the appropriate shapes.

Figure 7:
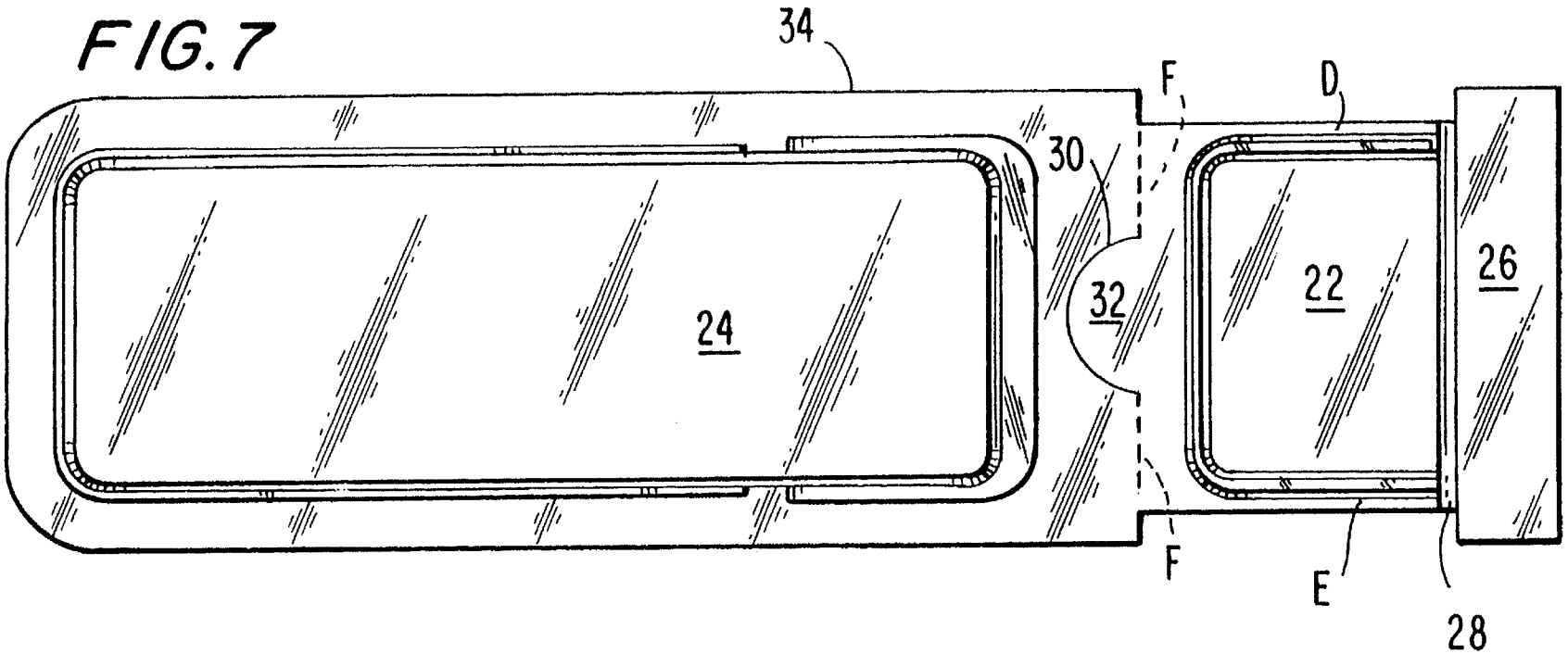
FIG. 7 is a top view of the dispenser housing and door of the present invention after being vacuum formed from a single piece of material, but before being separated for packaging.
Figure 8:
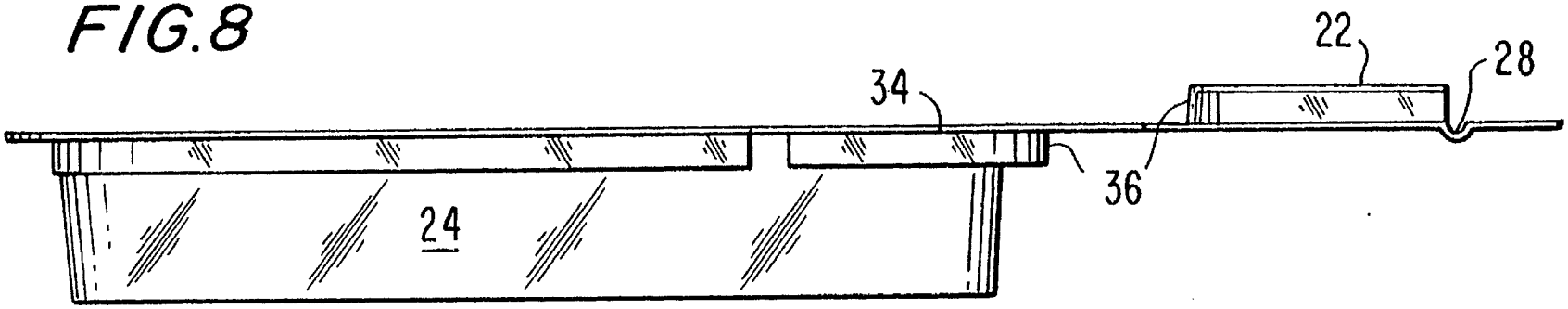
FIG. 8 is a side view the dispenser housing and door of the present invention after being vacuum formed from a single piece of material, but before being separated for packaging.

In a preferred embodiment, the cover 24 and the door 22 are formed from a single flat sheet of a transparent material as shown in FIGS. 7 and 8. The initial piece of material 34 is vacuum formed into a single piece of formed plastic comprising cover 24 and door 22. Once vacuum formed, the resulting product is then scored and/or perforated to remove material shown at D and E, and scored and/or perforated at the boundary F between cover 24 and door 22 to enables these parts to be separated. An undercut 36 of preferably 7 degrees is provided on the ridge portions of the cover 24 and door 22 to enable the door to be snapped closed with the undercut ridges 36 engaging each other.

Figure 1:
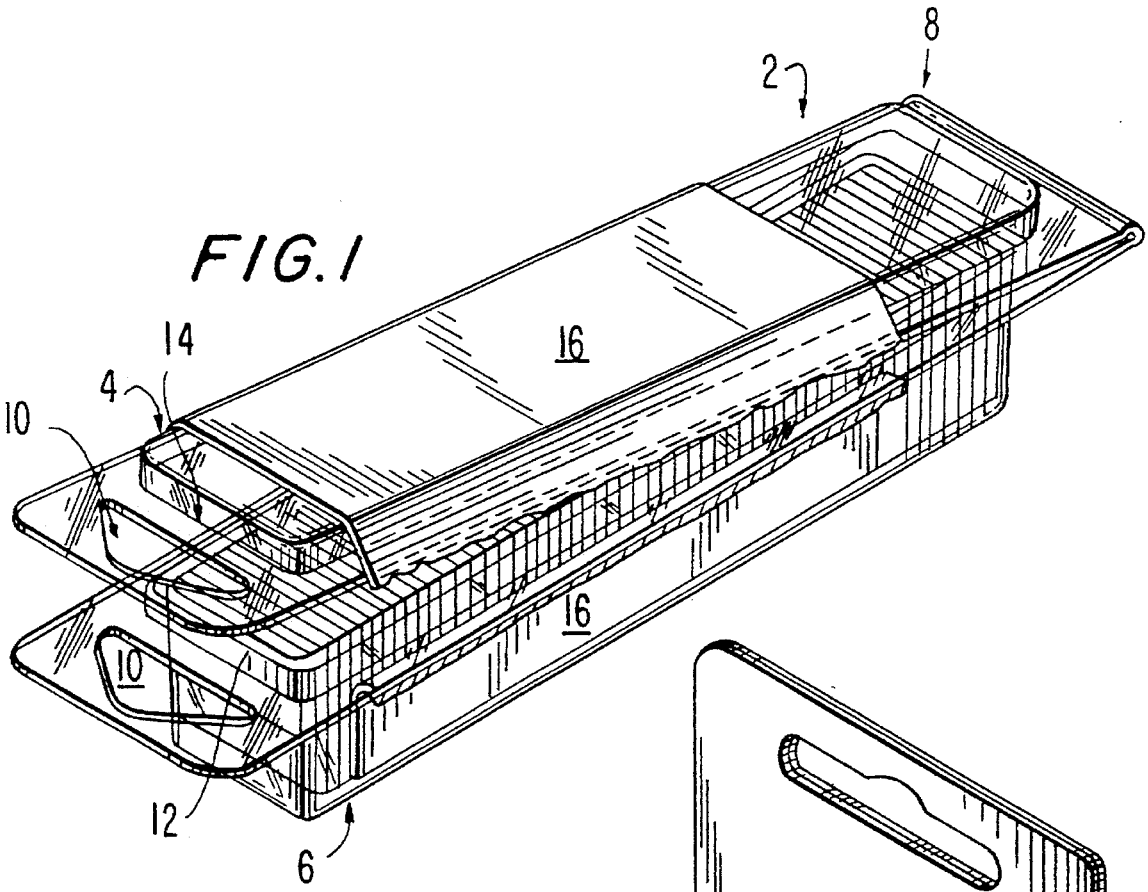
FIG. 1 shows a perspective view of a partially opened prior art blister display package.
Figure 2:
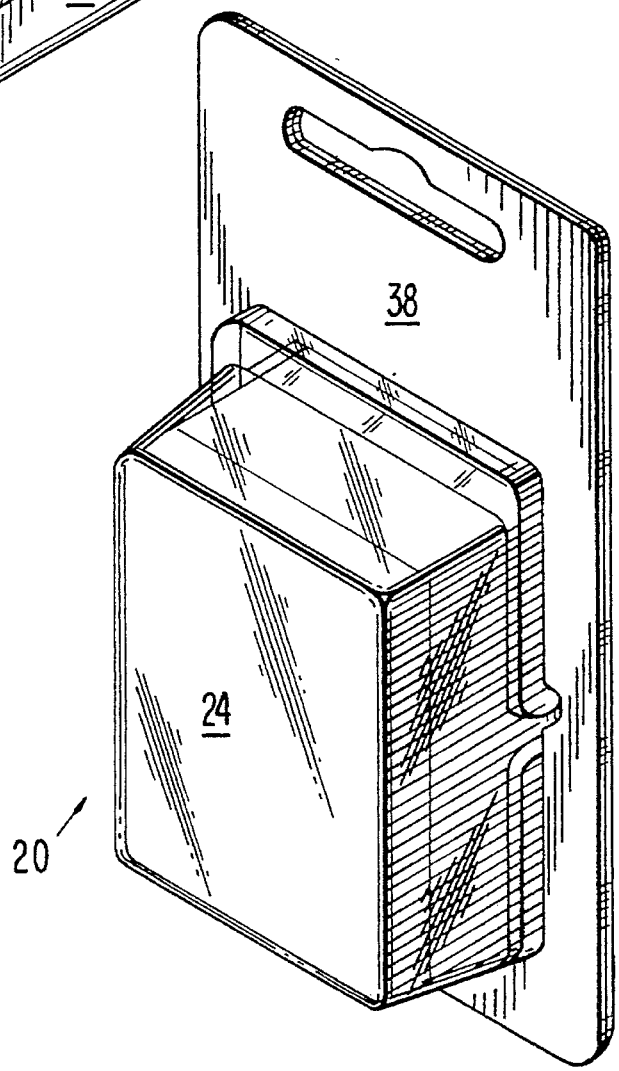
FIG. 2 shows a front prospective view of the blister display package of the present invention.
Figure 3:
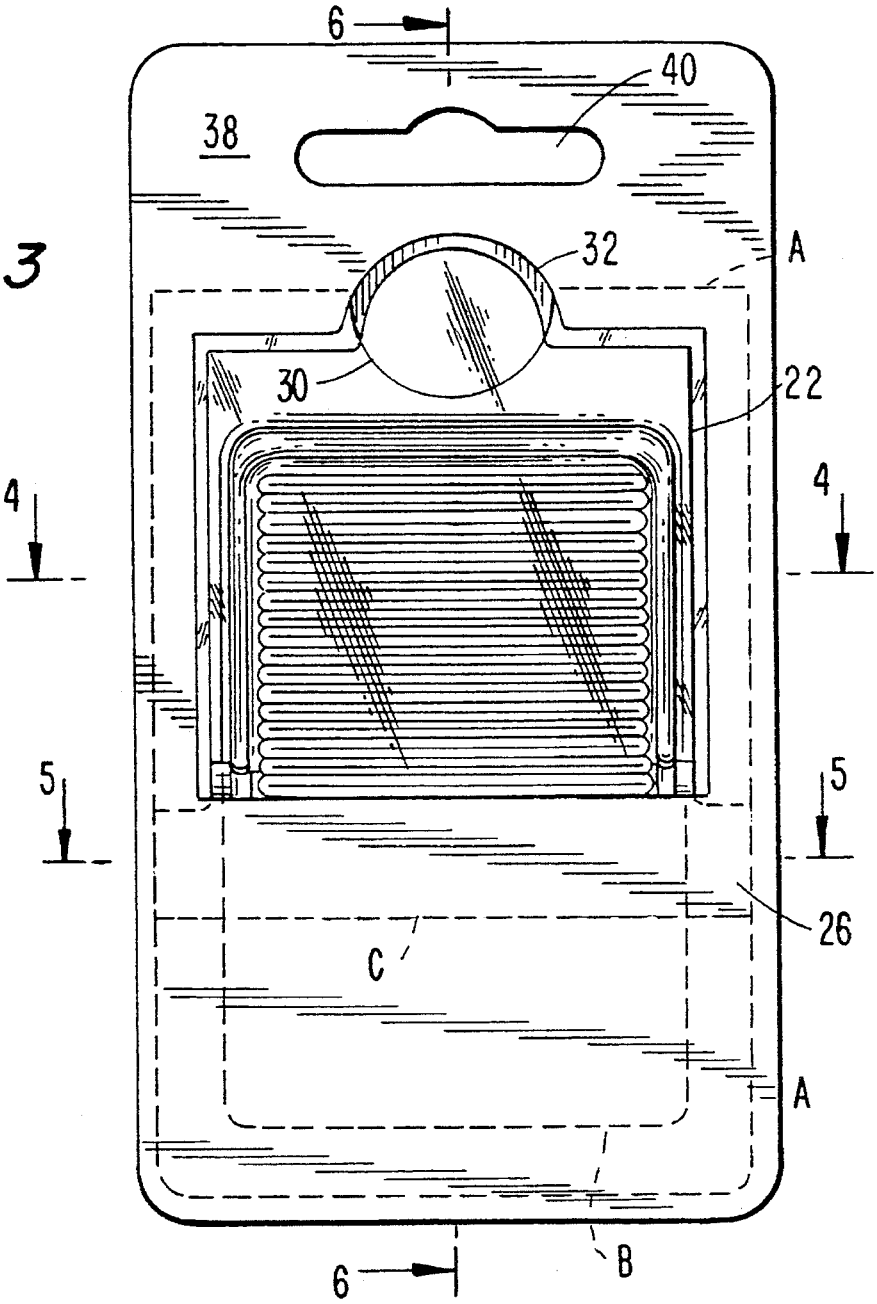
FIG. 3 shows a rear view of the blister display package of the present invention.
Figure 4:
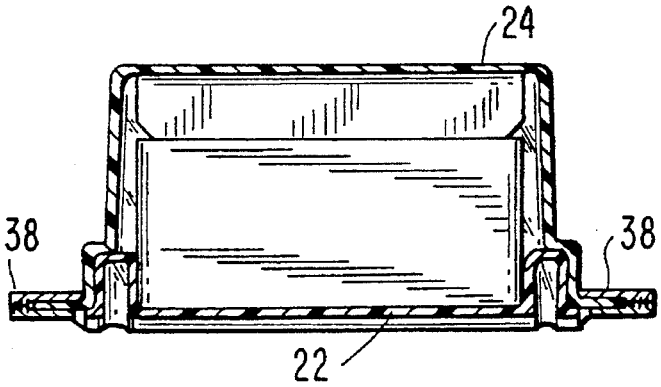
FIG. 4 shows a cross-sectional view of the blister display package of the present invention through Section 4—4.
Figure 5:
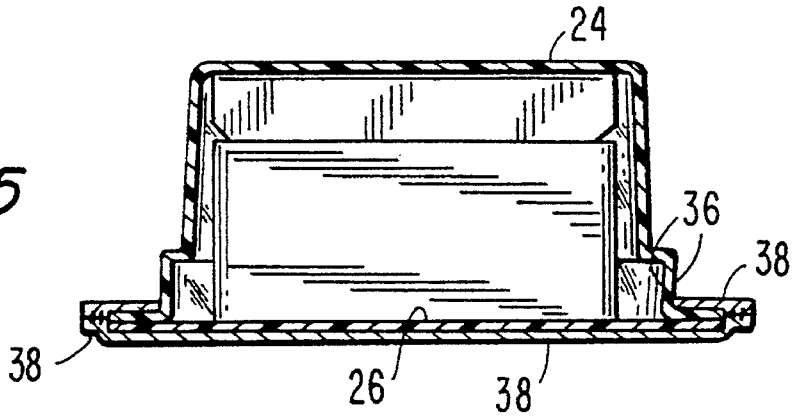
FIG. 5 shows a cross-sectional view of the blister display package of the present invention through Section 5—5.

In order to secure the door 22 to cover 24, the door 22 is mounted on the rear of cover 24 with the grooved ridges of each inter-engaged, and these are heat sealed between two cards 38. The cards 38 are preferably made out of a paper material having a coating suitable for being heat sealed to the material of the cover 24 and door 22. As shown in FIG. 3, a portion of the card 38 is cut away to allow the moveable portion of door 22 to be opened and closed, while the securing lip 26 of door 22 is secured between the cards 38. In an alternative embodiment, only one card 38 may be heat sealed to the rear of cover 24 to secure the door securing lip 26 to cover 24. Card 38 is provided with a cutout 40 to enable the display package to be mounted on a display rack. In either embodiment it is apparent that the cardboard packing material need not be torn in order to dispense items from the display package. It can also be seen that the door 22 is substantially flush with the rear of the cover 24 when the door 22 is closed.

A portion of tab 32 may be heat sealed to the card 38, if desired. This provides a tamper indication for the packaging. In order to open the package, the tab 32 must be pulled away from the card 38. Since these parts are heat sealed, some of the paper coating on the card will stick to the tab 32 when it is pulled away. Thus, if the package had been previously opened, tab 32 will have stuck thereto some of the display packaging from the card 38.

While the present invention has been described with respect to storing and dispensing razor blades, it is apparent that it may be used for displaying and dispensing other types of items including screws, nails, candy, food, etc. In fact, the present display package is suitable for dispensing most any substance for which it is desired to dispense the substance in limited quantities in a re-closeable package.

Moreover, while the present invention has been described with respect to mounting the resealable door on the rear of the cover, it is foreseeable that the resealable door may be mounted on the front of the housing 24 or in other positions on the housing 24 to achieve the same result discussed herein. For example, the housing could be constructed in a box-like fashion i.e. of a molded thermoplastic, with a cutout provided for the door 22 discussed herein. The door 22 could also be mounted to the housing in other manners than previously discussed. For example, the door could be glued to the housing, or sonically welded to the housing.

Although the present invention has been described in detail with respect to certain embodiments and examples, variations and modifications exist which are within the scope of the present invention as defined in the following claims.

What is claimed is:

1. A display package with a dispenser for dispensing objects from the package, the package comprising:

a) a vacuum-formed dispenser housing having a front and a rear, the dispenser housing comprising i) a front surface and side walls which cooperate to define a cavity sized to hold the objects to be dispensed, the cavity being open on the rear of the dispenser housing, at least a portion of the walls of the cavity adjacent to the opening comprising an undercut ridge; and ii) a peripheral lip extending laterally from the opening along the periphery of the opening;

b) a vacuum-formed dispenser door which comprises:

i) a securing lip to secure the dispenser door to the dispenser housing lip;

ii) a movable portion sized to sealingly cover at least a portion of the cavity opening, the movable portion comprising an undercut ridge along an outer edge thereof, the undercut ridge on the movable portion cooperating with the undercut ridge on the housing to enable the movable door to be snapped into and out of a closed position in which the movable door sealingly closes at least a portion of the cavity opening; and iii) a hinge extending between and integral with the securing lip and the movable portion for enabling opening and closing movement of the movable portion of the dispenser door; and c) a card fixedly attached to the rear of the housing, the card securing the dispenser door securing lip to the dispenser housing lip, the card further covering any non-covered portion of the dispenser housing opening, a portion of the card being cutout to enable the movable portion of the door to be opened and re-closed.

2. The display package according to claim 1 wherein the dispenser housing and the dispenser door are transparent.

3. The display package according to claim 1 comprising a pair of cards, wherein the dispenser door securing lip and the dispenser housing lip are sandwiched securely together between the cards, one of the cards being mounted to the front of the housing and comprising a cutout around the cavity, the other card being mounted to the rear of the housing and comprising a cutout to enable the movable portion of the door to be opened and re-closed.

4. The display package according to claim 1 wherein the movable portion of the dispenser door comprises a tab integral therewith for to allow the door to be more easily opened and closed.

5. A method of manufacturing a display package with a dispenser for dispensing objects from the package, the method comprising:

A) providing a flat sheet of transparent material suitable for being vacuum formed when heated;

B) heating and vacuum-forming the sheet into a vacuum formed sheet which comprises:

i) a dispenser housing having a front and a rear, the dispenser housing comprising:

a) a front surface and side walls which cooperate to define a cavity sized to hold the objects to be dispensed, the cavity being open on the rear of the dispenser housing, at least a portion of the walls of the cavity adjacent to the opening comprising an undercut ridge; and b) a peripheral lip extending laterally from the opening along the periphery of the opening; and ii) a vacuum-formed dispenser door which comprises:

a) a securing lip to secure the dispenser door to the dispenser housing lip;

b) a movable portion sized to sealingly cover at least a portion of the cavity opening, the movable portion comprising an undercut ridge along an outer edge thereof; and c) a hinge extending between and integral with the securing lip and the movable portion for enabling opening and closing movement of the movable portion of the dispenser door;

C) separating the dispenser housing from the dispenser door;

D) mounting the dispenser door on the rear of the dispenser housing with the undercut ridge on the movable portion aligned with and cooperating with the undercut ridge on the housing to enable the movable door to be snapped into and out of a closed position in which the movable door sealingly closes at least a portion of the cavity opening and with the securing lip aligned with the dispenser housing lip; and E) heat sealing a card to the rear of the housing with the card securing the dispenser door securing lip to the dispenser housing lip, the card covering any non-covered portion of the dispenser housing opening, a portion of the card being cutout to enable the movable portion of the door to be opened and re-closed.

6. The method according to claim 5 wherein the step of heat sealing the card comprises providing a pair of cards, and heat sealing the dispenser door securing lip and the dispenser housing lip between the cards, one of the cards being mounted to the front of the housing and comprising a cutout around the cavity, the other card being mounted to the rear of the housing and comprising a cutout to enable the movable portion of the door to be opened and re-closed.

* * * * *